US008077874B2

(12) United States Patent
Sapiejewski

(10) Patent No.: US 8,077,874 B2
(45) **Date of Patent: *Dec. 13, 2011**

(54) ACTIVE NOISE REDUCTION MICROPHONE PLACING

(75) Inventor: Roman Sapiejewski, Boston, MA (US)

(73) Assignee: Bose Corporation, Framingham, MA (US)

( * ) Notice: Subject to any disclaimer, the term of this patent is extended or adjusted under 35 U.S.C. 154(b) by 1551 days.

This patent is subject to a terminal disclaimer.

(21) Appl. No.: 11/409,896

(22) Filed: Apr. 24, 2006

(65) Prior Publication Data

US 2007/0253568 A1 Nov. 1, 2007

(51) Int. Cl.

| | |
|---|---|
| ***H04R 1/10*** | (2006.01) |
| ***H04R 3/00*** | (2006.01) |
| ***G10K 11/16*** | (2006.01) |

(52) U.S. Cl. ..... 381/74; 381/71.6; 381/95; 381/96

(58) Field of Classification Search ..... 381/72, 381/370, 71.6–71.7, 317, 74, 95–96

See application file for complete search history.

(56) References Cited

U.S. PATENT DOCUMENTS

| | | | | |
|---|---|---|---|---|
| 3,759,063 | A * | 9/1973 | Bendall | 464/99 |
| 4,494,074 | A | 1/1985 | Bose | |
| 5,182,774 | A | 1/1993 | Bourk | |
| 5,381,485 | A | 1/1995 | Elliott | |
| 5,809,156 | A | 9/1998 | Bartels et al. | |
| 5,949,897 | A | 9/1999 | Bartels et al. | |
| 2005/0259833 | A1 | 11/2005 | Scarpino et al. | |
| 2007/0253567 | A1 | 11/2007 | Sapiejewski | |

FOREIGN PATENT DOCUMENTS

| | | |
|---|---|---|
| EP | 0333411 | 9/1989 |
| EP | 0688143 | 12/1995 |
| EP | 1398991 | 3/2004 |
| EP | 1587342 | 10/2005 |
| GB | 2267411 | 12/1993 |
| WO | 8900746 | 1/1989 |

OTHER PUBLICATIONS

CN Office Action dated Dec. 11, 2009 for CN Appl. No. 200710104498.6.

Extended EP Search Report dated Feb. 17, 2009 for EP Appl. No. 07106780.5-1224 / 1850632.

Yu, Shiang-Hwua et al., Controller Design for Active Noise Cancellation Headphones Using Experimental Raw Data, IEEE/ASME Transactions on Mechatronics, vol. 6, No. 4, Dec. 2001.

Partial EP Search Report dated Mar. 4, 2009 for related EP Application No. 07106779.7-1240 / 1850631.

Extended EP Search Report dated May 27, 2009 for EP Appl. No. 07106779.7-1240.

EP Office Action dated Oct. 8, 2009 for EP 07106780.5-1224 / 1850632.

EP Notice of Allowance dated Jun. 11, 2010 for EP 07106780.5.

Roman Sapiejewski, "High Frequency Compensating," Patent Application, Nov. 1, 2007.

* cited by examiner

*Primary Examiner* — Devona Faulk
*Assistant Examiner* — George Monikang

(57) ABSTRACT

A method and apparatus for increasing phase margin in a feedback circuit of an active noise reduction headphone. The method includes providing an acoustic block comprising an acoustic driver comprising a voice coil mechanically coupled along an attachment line to an acoustic energy radiating diaphragm, the acoustic block further comprising a microphone positioned along a line parallel to an intended direction of vibration of the acoustic diaphragm and intersecting the attachment line, the acoustic block characterized by a magnitude frequency response compensating the magnitude frequency response by a compensation pattern that has a positive slope over at least one spectral range above 10 kHz.

8 Claims, 7 Drawing Sheets

ACTIVE NOISE REDUCTION MICROPHONE PLACING

BACKGROUND

This specification relates to feedback control in an active noise reduction headphone. Reference is made to U.S. Pat. No. 4,494,074, Bose, "Feedback Control."

SUMMARY

In one aspect of the invention, an apparatus for an active noise reduction headphone includes an acoustic driver assembly for an active noise reduction headphone. The acoustic driver may include a diaphragm and a voice coil, for applying mechanical force to the diaphragm along a force application line. The active noise reduction headphone may include a microphone with a microphone opening positioned within 2 mm of a line parallel to an intended direction of motion of the diaphragm and intersecting the force application line and structure for attenuating frequency response aberrations resulting from resonances of components of the acoustic driver. The structure may include a laminated diaphragm.

In another aspect, an apparatus for an active noise reduction headphone includes an acoustic driver for an active noise reduction headphone, includes a highly damped diaphragm and a voice coil attached to the diaphragm along an attachment line. The active noise reduction headphone also includes a microphone, positioned along a positioning line parallel to an intended direction of motion of the diaphragm and intersecting the attachment line.

In another aspect, a noise reduction headphone includes an earphone for being urged against a user's head to enclose a cavity. The earphone includes an acoustic driver comprising a diaphragm and a voice coil, for applying mechanical force to the diaphragm along a force application line to cause the diaphragm to radiate acoustic energy into the cavity. The earphone further includes a microphone enclosed by the cavity for transducing acoustic energy in the cavity to a noise signal, positioned within 2 mm of a line parallel to an intended direction of motion of the diaphragm and intersecting the force application line; and structure for attenuating frequency response aberrations resulting from resonances of components of the acoustic driver. The structure may be for attenuating frequency response aberrations resulting from resonances of components of a voice coil component of the acoustic driver. The structure may include a damped diaphragm. The opening of the microphone may be positioned on the line parallel to the intended direction of motion.

In another aspect of the invention, a method for increasing phase margin in a feedback circuit of an active noise reduction headphone includes providing an acoustic block that includes an acoustic driver. The acoustic driver includes a voice coil mechanically coupled along an attachment line to an acoustic energy radiating diaphragm. The acoustic block further includes a microphone positioned along a line parallel to an intended direction of vibration of the acoustic diaphragm and intersecting the attachment line. The acoustic block is characterized by a magnitude frequency response. The method includes compensating the magnitude frequency response by a compensation pattern that has a positive slope over at least one spectral range above 10 kHz.

In another aspect, an active noise reduction apparatus includes an acoustic driver. The acoustic driver includes a diaphragm and a voice coil, for applying mechanical force to the diaphragm along a force application line; a microphone with a microphone opening positioned within 2 mm of a line parallel to an intended direction of motion of the diaphragm and intersecting the force application line; and structure for attenuating frequency response aberrations resulting from resonances of components of the acoustic driver. The apparatus also includes an acoustic block characterized by a first magnitude frequency response and a compensator characterized by a second magnitude frequency response to combine the second magnitude frequency response with the first magnitude frequency response to provide a combined magnitude frequency response. The second magnitude frequency response is characterized by a pattern that has a positive slope at a frequency interval in the spectral portion above 10 kHz.

Other features, objects, and advantages will become apparent from the following detailed description, when read in connection with the following drawing, in which:

DESCRIPTION

Figure 1A:
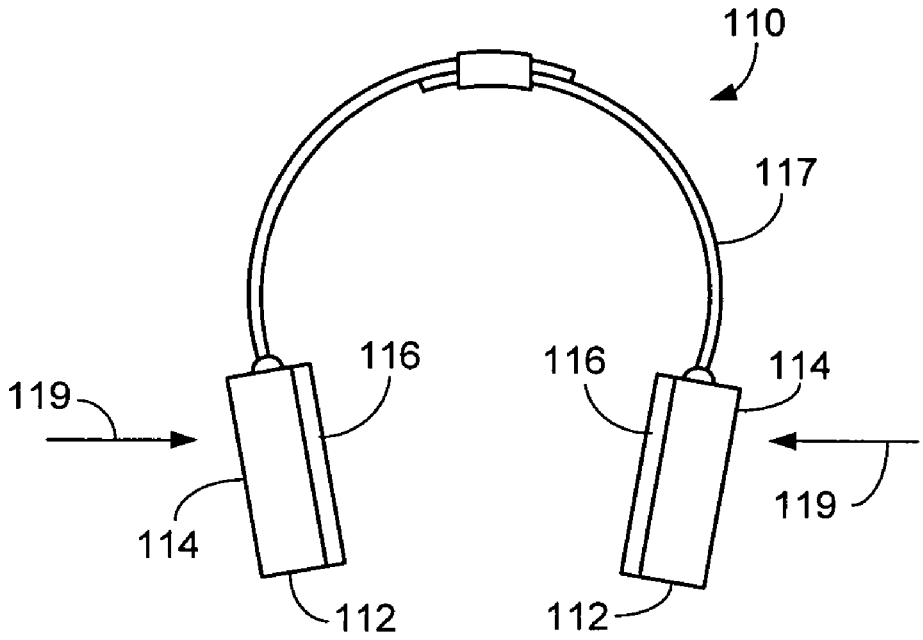
FIG. 1A is a view of noise reduction headphone.

Though the elements of several views of the drawing may be shown and described as discrete elements in a block diagram and may be referred to as "circuitry", unless otherwise indicated, the elements may be implemented as one of, or a combination of, analog circuitry, digital circuitry, or one or more microprocessors executing software instructions. The software instructions may include digital signal processing (DSP) instructions. Some of the processing operations may be expressed in terms of the calculation and application of coefficients. The equivalent of calculating and applying coefficients can be performed by other analog or digital signal processing techniques and those techniques are included within the scope of this patent application.

Referring to FIG. 1A, there is shown an active noise reduction headphone 110. The headphone includes two earphones 112, connected by a headband. Each earphone 112 may include a cup shaped shell 114 and a cushion 116. The headband 117 exerts a force in an inward direction as represented by arrows 119 so that the cushion 116 is urged against the head of a user and surrounding the ear (typically referred to as circumaural) to enclose a cavity which may include the outer ear and ear canal; or urged against the ear of the user (typically referred to as supra-aural) to enclose a cavity, which may include the outer ear and ear canal; or urged into the ear canal (typically referred to as interaural) to define a cavity, which may include the ear canal. Interaural headphones may be implemented without the headband, by inserting a portion of the earphone into the ear canal. In the cavity are noise reduction elements that will be described below in the discussion of FIG. 1B.

Figure 1B:
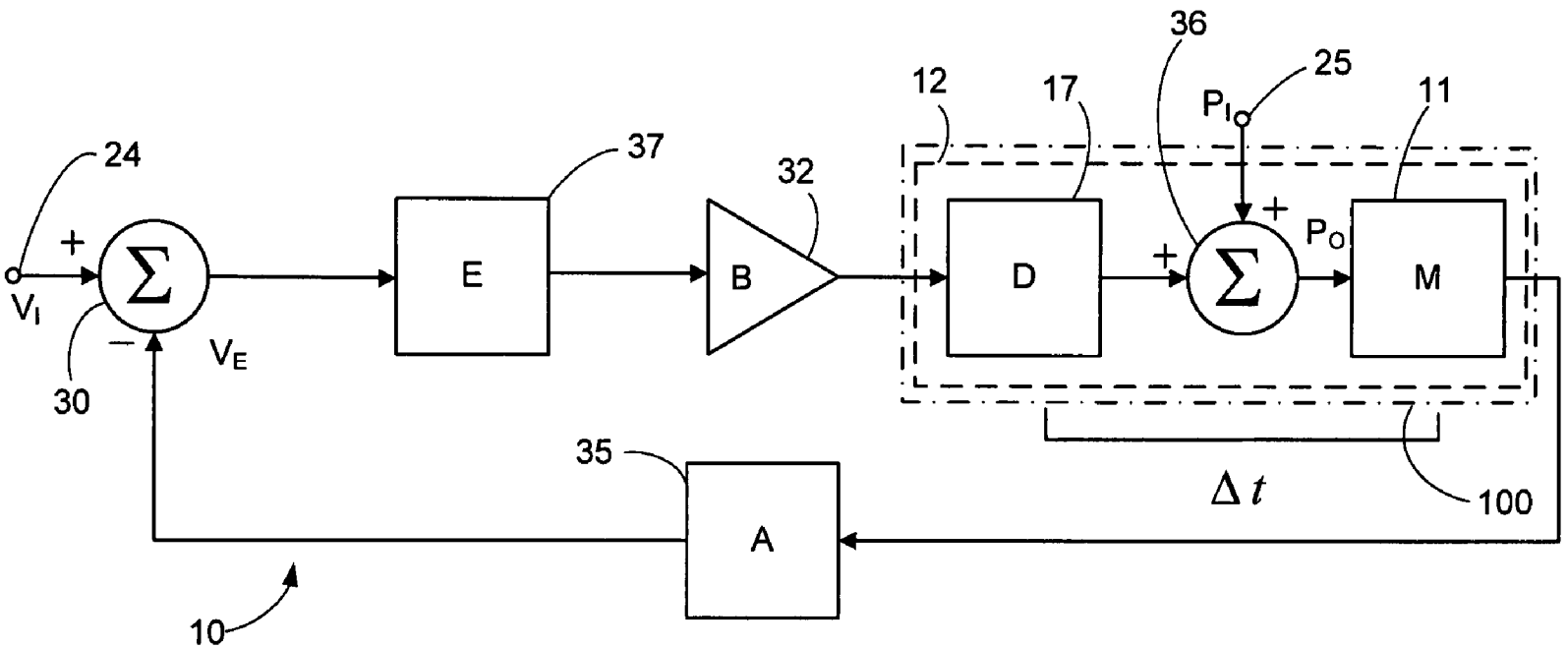
FIG. 1B is a block diagram of a logical arrangement of a feedback loop for use in the headphone of FIG. 1A.

Referring to FIG. 1B, there is shown a block diagram illustrating the logical arrangement of a feedback loop in an active noise reduction headphone. A signal combiner 30 is combiningly coupled to a terminal 24 for an input audio signal $V_I$ and to a feedback preamplifier 35 and is coupled to a compensator 37 which is in turn coupled to a power amplifier 32. Power amplifier 32 is coupled to acoustic driver 17 in a cavity represented by dotted line 12. Acoustic driver 17 is coupled to a combiner 36, as is terminal 25 which represents noise $P_I$ that enters cavity 12. The acoustic output $P_O$ of combiner 36 is applied to a microphone 11 coupled to output preamplifier 35, which is in turn differentially coupled to signal combiner 30.

Cavity 12 represents the cavity formed when an earphone of a noise reducing headphone is pressed in, against, or around a user's ear. Combiner 36 is not a physical element, but represents the acoustic summation of noise $P_I$ entering cavity 12 from the external environment and acoustic output radiated into cavity 12 by acoustic driver 17, the summation resulting in acoustic energy $P_O$ being present in cavity 12. Together, the acoustic elements of FIG. 1B, including the microphone 11, the acoustic driver 17, and the cavity 12 may be referred to as the "acoustic block" 100 which will be discussed later.

In operation, an amplified error signal $V_E$ is combined subtractively with input audio signal $V_I$ at signal combiner 30. The summed signals are presented to compensator 37. Compensator 37 provides phase and gain margin to meet the Nyquist stability criterion. Increasing the phase margin can extend the bandwidth over which the system remains stable, can increase the magnitude of feedback applied over a frequency range to increase active noise reduction, or both. Aspects of compensator 37 will be discussed in more detail below. Compensation, which includes applying a pattern in which the magnitude varies with frequency, is similar to the process called "equalization" and for the purposes of this specification an equalization that is applied within feedback circuit 10 is equivalent to compensation. There may be other equalizations in the system; for example audio signal $V_I$ may be equalized prior to being applied to combiner 30. Power amplifier 32 amplifies the compensated signal presented to acoustic driver 17. Acoustic driver 17 transduces the amplified audio signal to acoustic energy, which combines with noise $P_I$ entering cavity 12 to form combined acoustic energy $P_O$. Microphone 11 transduces combined acoustic energy $P_O$ to an audio signal, which is amplified by preamp 35 and presented subtractively as an error signal $V_E$ to signal combiner 30.

The closed loop transfer function of the circuit of FIG. 1 is $$\frac{P_O}{V_I} = \frac{EBD}{1 + EBDMA}$$

where E, B, D, M, and A represent the frequency dependent transfer functions of the compensator, the power amplifier, the acoustic driver, the microphone, and the preamp, respectively. If the EBDMA term of the denominator=−1 (the equivalent of |EBDMA|=1 and a phase angle of −180°) the circuit becomes unstable. It is therefore desirable to arrange the circuit so that the there is a phase margin (as described below) so that the phase angle of EBDMA does not approach −180° for any frequency at which |EBDMA|≧1. For example, if the circuit is arranged so that at any frequency at which |EBDMA|≧1, the phase angle is not more negative than −135°, the phase margin is at least 180°−135° or 45°. Stated differently, to maintain a typical desirable phase margin of no less than 45°, the phase angle of EBDMA at the crossover frequency (the frequency at which the gain of EBDMA is unity or 0 dB) should be ≦−135°. Causing the phase of transfer function EBDMA to be less negative in the vicinity of the crossover frequency can allow an increase in the crossover frequency, thereby extending the effective bandwidth of the system.

Changes of phase angle as a function of frequency are a result of at least two causes: time delays and phase shifts associated with the magnitude of the transfer functions E, B, D, M, and A, which may be frequency dependent. Time delays (for example delay Δt of FIG. 1 representing the time delay between the radiation of acoustic energy by acoustic driver 17 and the arrival of the acoustic energy at microphone 11) act as a phase shift that is linear as a function of frequency. Other examples of time delays are delays in signal processing components, particularly digital DSP systems such as the components of FIG. 1. Phase shifts associated with transfer functions E, B, D, M, and A are typically variable with respect to frequency. It is desirable to reduce time delays and to reduce or compensate for phase shifts associated with transfer function EBDMA so that the phase angle of the circuit does not approach −180° and preferably does not exceed −135° for frequencies at which the magnitude of EBDMA exceeds unity, or zero if expressed in dB.

Figure 2A:
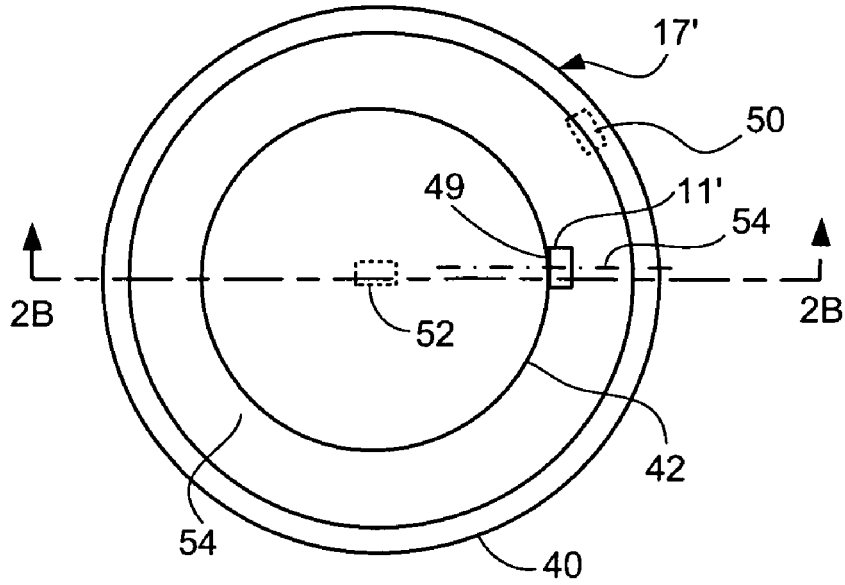
FIG. 2A is a diagrammatic top view of an arrangement that reduces time delay between the radiation of acoustic energy by an acoustic driver and arrival of the acoustic energy at a microphone associates with the noise reduction headphone.
Figure 2B:
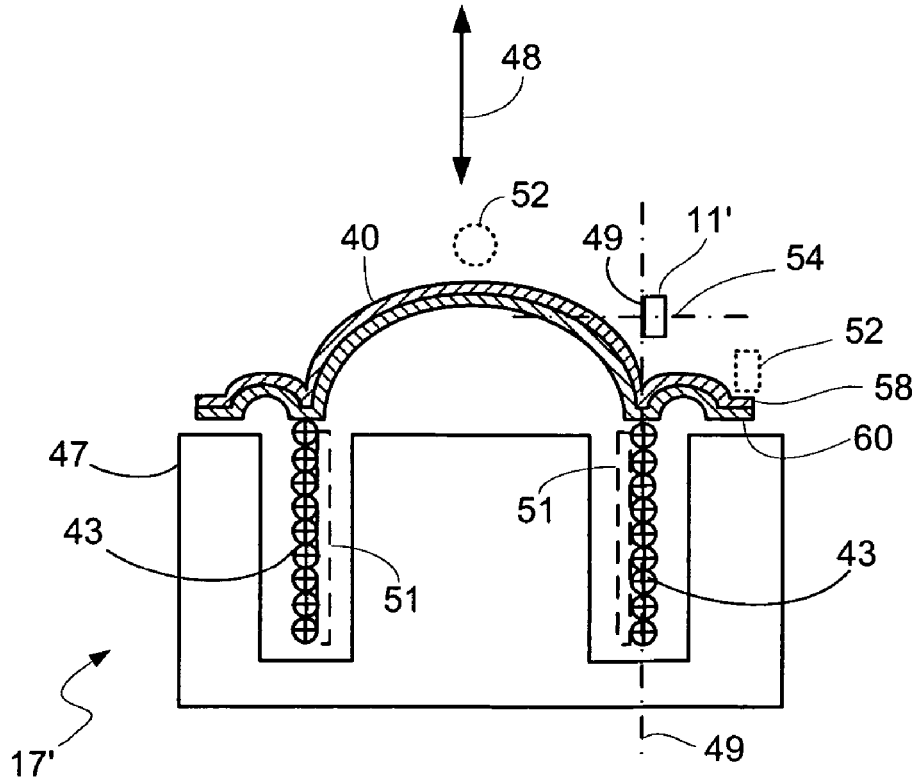
FIG. 2B is as diagrammatic cross-sectional view of the arrangement of FIG. 2A.

Referring to FIGS. 2A and 2B, there are shown a top view and a cross-sectional view taken along lines 2B-2B of FIG. 2A, respectively, of an arrangement that reduces the time delay Δt (of FIG. 1) between the radiation of acoustic energy by acoustic driver 17 and the arrival of the acoustic energy at microphone 11'. An acoustic driver 17' includes a voice coil 43 mechanically coupled along a line 42 to a diaphragm 40. The voice coil is typically tubular, and the attachment line 42 is typically circular, corresponding to one end of the tubular form. The voice coil coacts with a magnetic structure 47 to cause the voice coil to move linearly, in an intended direction of motion, indicated by arrow 48. The voice coil 43 exerts a force on diaphragm 40, causing diaphragm 40 to vibrate in the direction indicated by arrow 48 to radiate acoustic energy. Microphone 11 is positioned near diaphragm 40 along a line 49 intersecting attachment line 42 and parallel to the intended direction of motion indicated by arrow 48. In some embodiments, microphone 11 is oriented with the opening perpendicular to the direction of motion 48 and facing radially inward relative to the diaphragm 40. Preferably, the microphone 11 is placed so that the opening is within 2 mm of line 49 and may be aligned up with line 49. In the direction indicated by arrow 48, microphone 11' is positioned as near as possible to diaphragm 40 to minimize the time delay between the radiation of acoustic energy from diaphragm 40, but not so close as to interfere with the vibration of diaphragm 40 or to negatively affect pressure gradient.

For purposes of illustration, microphone 11 is shown as thin cylindrical microphones. Other types of microphones are suitable.

An arrangement according to FIGS. 2A and 2B is advantageous because the time delay between the application of force by the voice coil to the diaphragm along line 42 and the radiation of acoustic energy (and therefore the time delay between the application of force by the voice coil and the arrival of acoustic energy at microphone 11') is less than the time delay if the microphone were placed at a position not aligned with the attachment line 42 between the voice coil 43 and the diaphragm 40, for example at point 52 over the center of the diaphragm or point 50 over the edge of the diaphragm.

An arrangement according to FIGS. 2A and 2B may be subject to frequency response aberrations such as peaks or dips due to resonances of voice coil 43. The aberrations may be reduced by a number of methods. One method is to provide a highly damped diaphragm, such as a diaphragm with laminar layers 58 and 60. In some implementations, top layer 58 is polyurethane of average thickness 55 microns and lower layer 60 is polyetherimide of average thickness 20 microns. Another method is to use stiffer material for the voice coil 43 or provide stiffening structure 51 for the voice coil 43 to shift the resonant frequency out of the range of operation of the acoustic driver.

Figure 3:
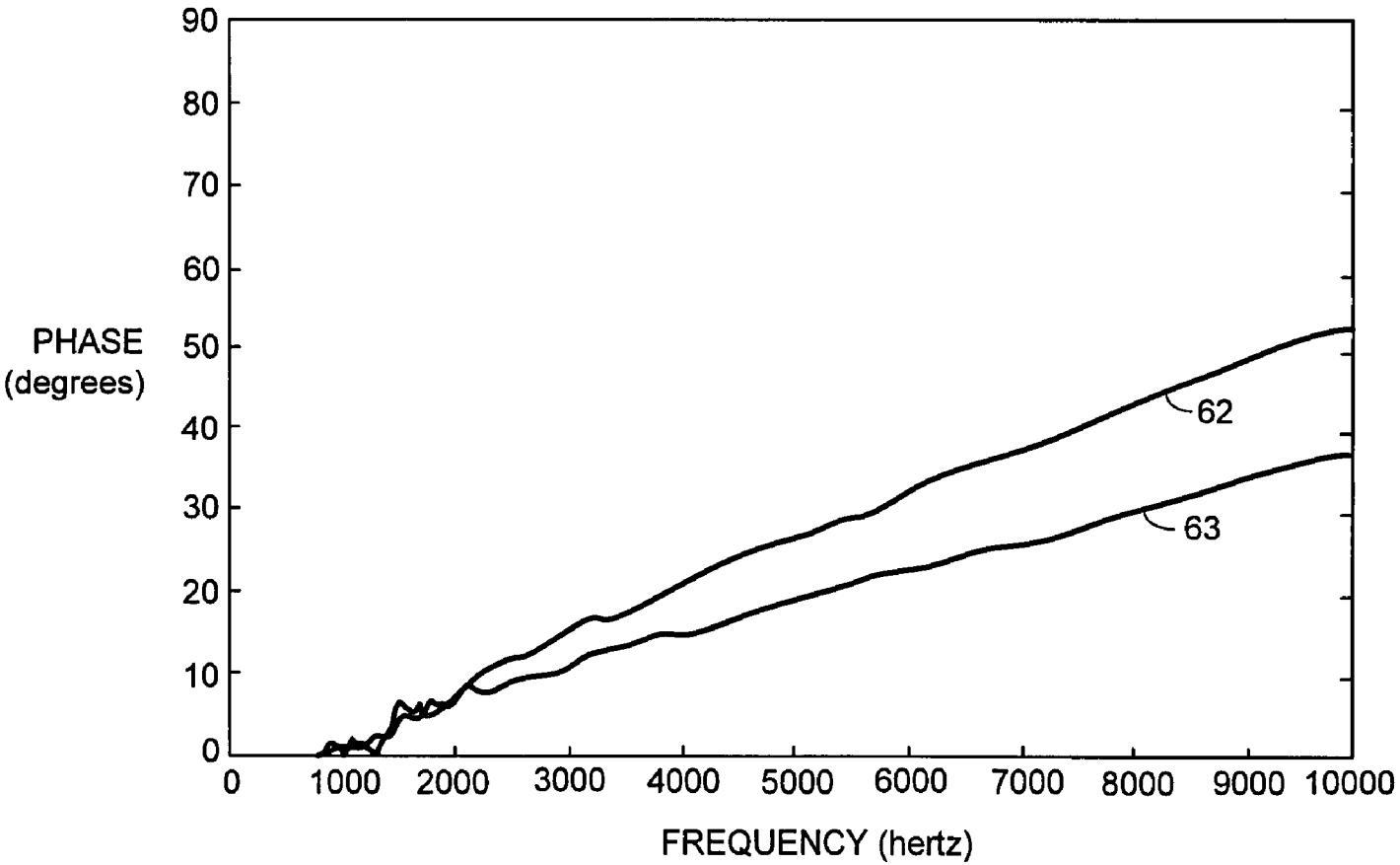
FIG. 3 is a plot of non-minimum phase delay.

FIG. 3 shows a plot (curve 62) of the non-minimum phase delay (resulting from the time delay) as a function of frequency of a microphone placed at a point 52 (of FIG. 2A) above the center of a diaphragm and a plot (curve 63) of a microphone placed according to microphone 11 of FIG. 2A, In the plot of FIG. 3, the phase delay is expressed as positive degrees. The positive degrees of FIG. 3 are equivalent to negative degrees in other sections of this specification. For example, +40 degrees in FIG. 3 is equivalent to −40 degrees in the discussion of FIG. 1.

Figure 4:
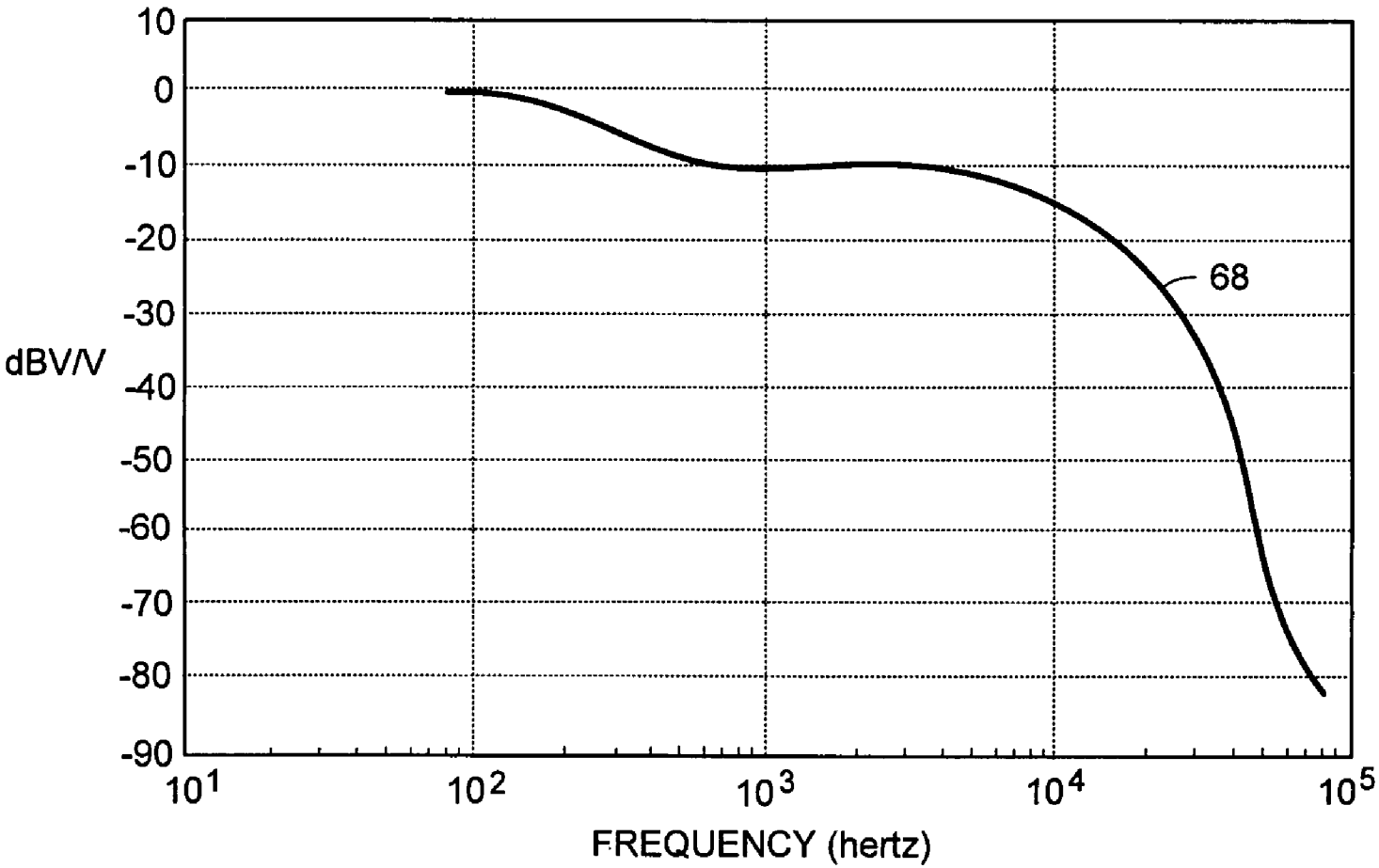
FIG. 4 is a plot of magnitude response as a function of frequency.

FIG. 4 shows the magnitude response 68 as a function of frequency of a typical acoustic block including acoustic driver 17, microphone 11, and cavity 12 of FIG. 1. There is an approximately $2^{nd}$ order rolloff between 10 kHz and 20 kHz and a very substantial $5^{th}$ or greater order rolloff above 20 kHz. Or characterized differently, the curve has a low pass shelving response shape between 10 kHz and 100 kHz. Conventionally, the frequency range between 10 kHz and 100 kHz is considered of little importance, because for the most part it is above the audible range of frequencies and because it is more than a decade above the typical high crossover frequency of active noise reduction headphone feedback loops. However, the phase change associated with the steep rolloff above 10 kHz may affect the phase angle of the feedback loop at frequencies in the audible range of frequencies.

Figure 5:
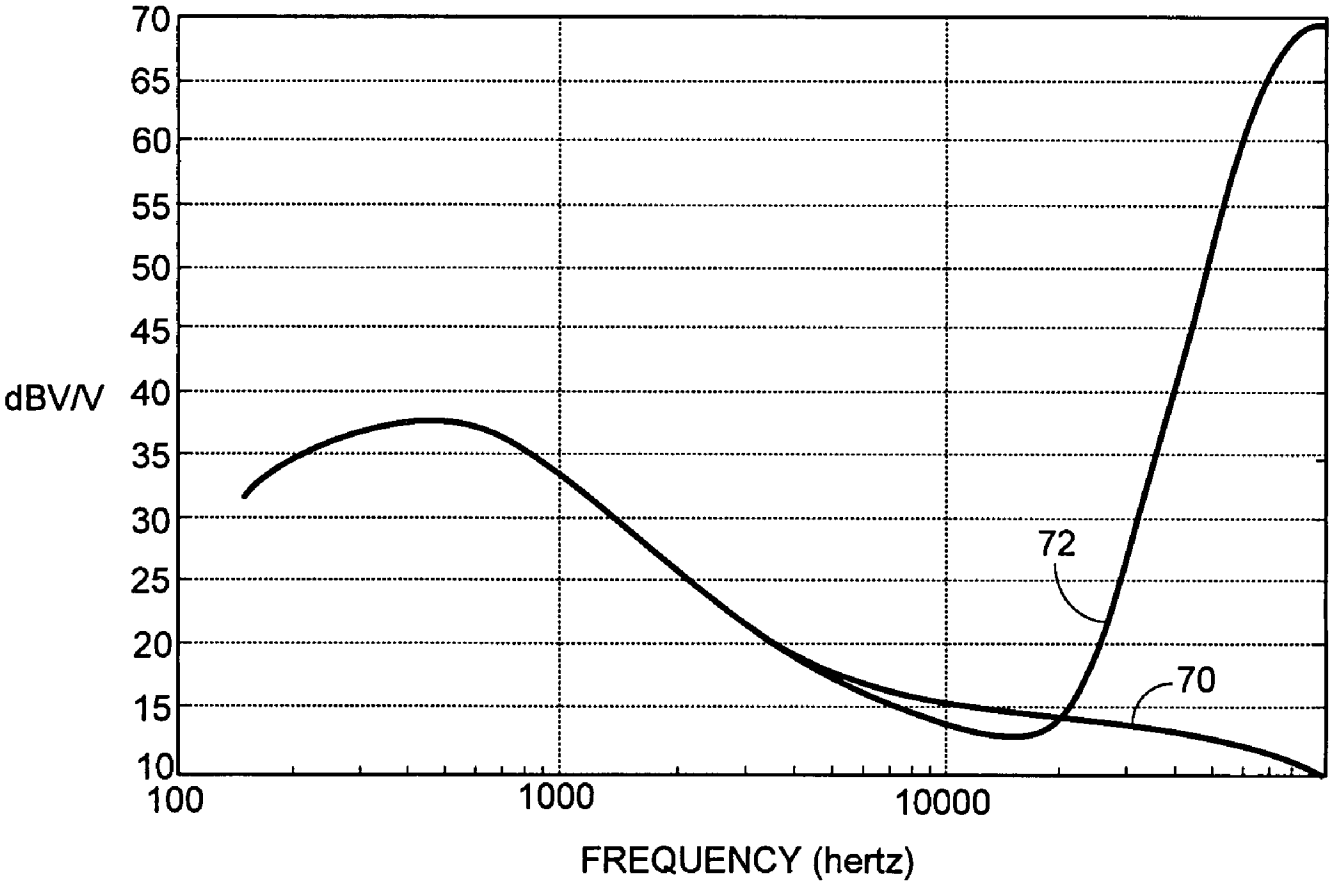
FIG. 5 is a plot of pattern of magnitude compensation as a function of frequency.

FIG. 5 shows a pattern of magnitude compensation as a function of frequency that may be applied by compensator 37. Curve 70 represents a conventional compensation pattern, with a slight rolloff of compensation applied in the frequency range between 10 kHz and 100 kHz. Curve 72 represents a compensation pattern with a steeply increasing amount of compensation applied in at least a portion of the frequency range between 10 kHz and 50 kHz and up to 100 kHz. In the range between 20 kHz and 50 kHz and up to 100 kHz, the curve has a high positive slope (greater than $2^{nd}$ order, for example, $5^{th}$ order) on the same order as curve 68 rolls off. The slope remains positive for at least an octave; for example 20 kHz to 50 kHz is more than one octave and 20 kHz to 100 kHz is more than two octaves. An example of a design for such active noise reduction apparatus is given in a co-pending patent application "High Frequency Compensating" of Roman Sapiejewski, filed on the same day as this application and incorporated here by reference.

Figure 6:
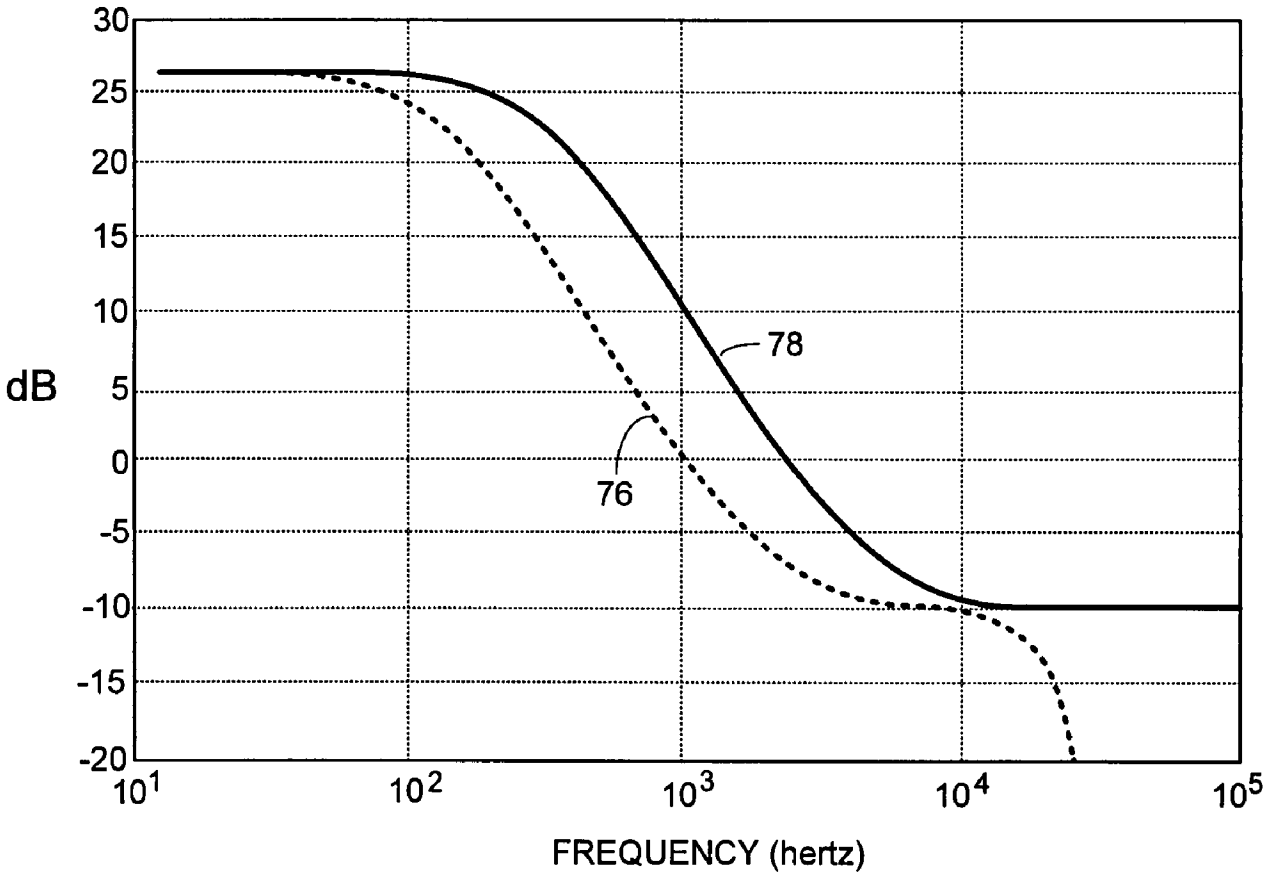
FIG. 6 is a plot of improvement of open loop gain of an active noise reduction headphone employing the compensation pattern of FIG. 5

FIG. 6 shows the improvement in open loop gain of an active noise reducing headphone (curve 78) employing the compensation pattern of curve 72 of FIG. 5 over an active noise reducing headphone (curve 76) using a conventional compensation pattern, such as curve 70 of FIG. 5. The headphone employing the compensation pattern of curve 72 FIG. 5 provides more than an additional octave of bandwidth of open loop gain.

The compensation pattern of FIG. 5 may be implemented by an analog or digital circuit, but is most conveniently implemented as an analog filter including one or more operational amplifiers with sufficient gain-bandwidth product and appropriately arranged resistors and capacitors and a power source.

Other implementations are within the scope of the claims.

What is claimed is:

1. Apparatus for an active noise reduction headphone comprising:

an acoustic driver, comprising a diaphragm and a voice coil, for applying mechanical force to the diaphragm along a force application line;

a microphone with a microphone opening positioned within 2 mm of a line parallel to an intended direction of motion of the diaphragm and intersecting the force application line; and structure for attenuating frequency response aberrations resulting from resonances of components of the acoustic driver.

2. Apparatus in accordance with claim 1, wherein the structure comprises a laminated diaphragm.

3. Apparatus in accordance with claim 1, wherein the microphone opening is placed along the line parallel to the intended direction of motion and passing through the force application line.

4. Apparatus for an active noise reduction headphone comprising:

an acoustic driver for an active noise reduction headphone, comprising a highly damped diaphragm and a voice coil attached to the diaphragm along an attachment line; and a microphone, positioned along a positioning line parallel to an intended direction of motion of the diaphragm and intersecting the attachment line.

5. A noise reduction headphone, comprising:

an earphone for being urged against a user's head to enclose a cavity, comprising acoustic driver comprising a diaphragm and a voice coil, for applying mechanical force to the diaphragm along a force application line to cause the diaphragm to radiate acoustic energy into the cavity;

a microphone enclosed by the cavity for transducing acoustic energy in the cavity to a noise signal, positioned within 2 mm of a line parallel to an intended direction of motion of the diaphragm and intersecting the force application line; and structure for attenuating frequency response aberrations resulting from resonances of components of the acoustic driver.

6. A headphone in accordance with claim 5, wherein the structure is for attenuating frequency response aberrations resulting from resonances of components of a voice coil component of the acoustic driver.

7. A headphone in accordance with claim 5, wherein in the structure comprises a damped diaphragm.

8. Active noise reduction apparatus comprising: an acoustic driver, comprising a diaphragm and a voice coil, for applying mechanical force to the diaphragm along a force application line;

a microphone with a microphone opening positioned within 2 mm of a line parallel to an intended direction of motion of the diaphragm and intersecting the force application line; and structure for attenuating frequency response aberrations resulting from resonances of components of the acoustic driver; and an acoustic block characterized by a first magnitude frequency response;

a compensator characterized by a second magnitude frequency response to combine the second magnitude frequency response with the first magnitude frequency response to provide a combined magnitude frequency response, wherein the second magnitude frequency response is characterized by a pattern that has a positive slope at a frequency interval in the spectral portion above 10 kHz.

* * * * *